US007360914B2

(12) United States Patent
Kim

(10) Patent No.: US 7,360,914 B2
(45) Date of Patent: Apr. 22, 2008

(54) HANDHELD TACTICAL DEVICES

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 189 days.

(21) Appl. No.: 11/266,654

(22) Filed: Nov. 2, 2005

(65) Prior Publication Data

US 2006/0164824 A1 Jul. 27, 2006

Related U.S. Application Data

(60) Provisional application No. 60/647,048, filed on Jan. 25, 2005.

(51) Int. Cl.
*F21V 33/00* (2006.01)

(52) U.S. Cl. ..... 362/119; 362/96; 362/109

(58) Field of Classification Search ..... 362/109, 362/119, 120, 208, 234, 253, 102, 399; 7/113, 7/132; 30/123, 125, 161
See application file for complete search history.

(56) References Cited

U.S. PATENT DOCUMENTS

| | | | | |
|---|---|---|---|---|
| 1,144,210 | A | 6/1915 | Kincaid | |
| 1,361,021 | A | 12/1920 | Copeman | |
| 1,439,404 | A | 12/1922 | Cotharin | |
| 1,868,778 | A | 7/1932 | Tomney | |
| 2,242,536 | A | 5/1941 | Montgomery | |
| 2,674,685 | A | 4/1954 | Young | |
| 3,510,643 | A | 5/1970 | File | |
| 4,186,851 | A | 2/1980 | Cantor | |
| 4,669,186 | A | 6/1987 | Liu | |
| 4,733,337 | A | 3/1988 | Bieberstein | |
| 5,072,342 | A | 12/1991 | Minovitch | |
| 5,509,581 | A | 4/1996 | Parsons | |
| 5,642,932 | A | 7/1997 | Matthews | |
| 5,839,624 | A | 11/1998 | Parsons | |
| 5,842,601 | A | 12/1998 | Pierpoint | |
| 5,842,602 | A | 12/1998 | Pierpoint | |
| 5,857,268 | A | 1/1999 | Park | |
| 5,859,588 | A | 1/1999 | Malone et al. | |
| D412,096 | S | 7/1999 | Kung et al. | |
| D412,355 | S | 7/1999 | Saetherbo | |
| 6,126,040 | A | 10/2000 | Hippensteel | |
| 6,135,608 | A * | 10/2000 | Lin | 362/119 |
| 6,196,419 | B1 | 3/2001 | Hancy et al. | |
| 6,336,731 | B1 * | 1/2002 | Chien | 362/120 |
| 6,419,371 | B1 * | 7/2002 | McCalla et al. | 362/119 |

(Continued)

OTHER PUBLICATIONS

La Police Gear, http://www.lapolicegear.com/aspkeydefpep.html, ASP Key Defender Pepper Spray (OC) baton, Jan. 24, 2005 Internet advertisement.

*Primary Examiner*—Y. My Quach-Lee
(74) *Attorney, Agent, or Firm*—David Weiss

(57) ABSTRACT

Handheld tactical devices combining a weapon with an emission generator, and specifically combinations of a tubular handle with a detachably securable knife blade or baton body, together with a flashlight or chemical spray device removably insertable in the tubular handle. The preferred spray device embodiment emits dual sprays and includes a thumb-operable cover for permitting a user to both expose and depress the spray device's pushbutton actuator for instantly actuating the spray device.

41 Claims, 8 Drawing Sheets

U.S. PATENT DOCUMENTS 6,511,199 B1 1/2003 Chung
6,841,941 B2 1/2005 Kim et al.
2003/0112622 A1* 6/2003 Chu et al. ..... 362/109
2005/0077837 A1 4/2005 Kim et al.

* cited by examiner

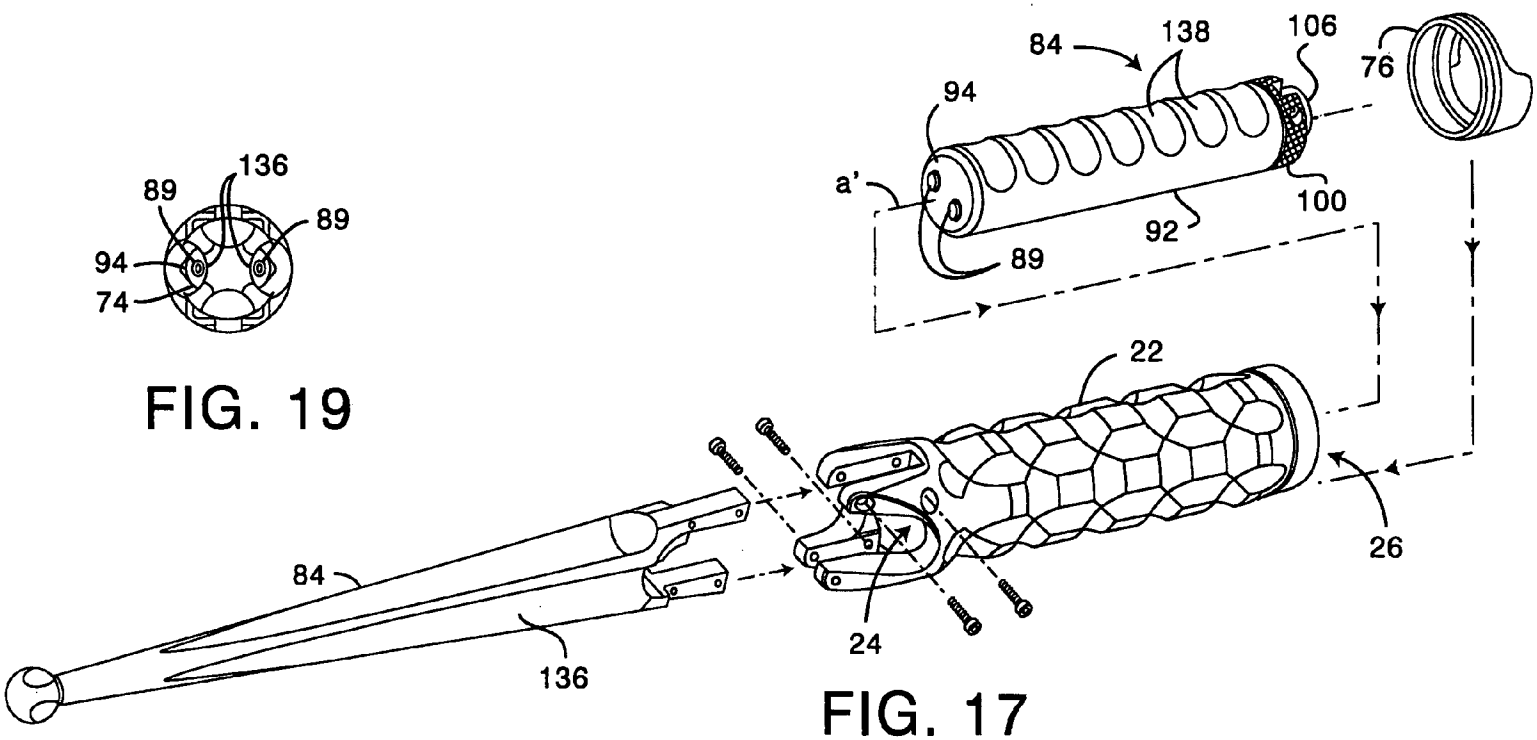
FIG. 17
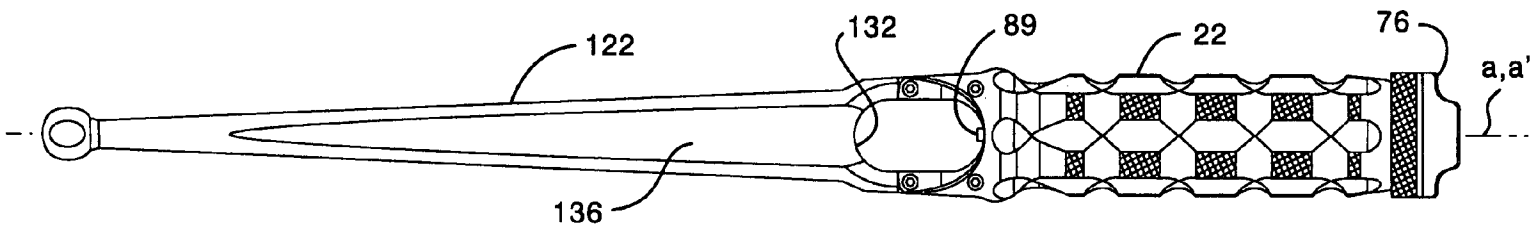
FIG. 18
FIG. 19

HANDHELD TACTICAL DEVICES

CROSS REFERENCE TO RELATED APPLICATION

This application claims the benefit of U.S. Provisional Application No. 60/647,048, filed Jan. 25, 2005, which application is incorporated herein by reference.

BACKGROUND OF THE INVENTION

This invention relates to handheld tactical devices, and more particularly to systems for attaching two tactical devices to one another for being held by a person.

Apparatus combining a handle with various objects, such as tools, culinary utensils and knives, are generally well know. Examples of patents disclosing such combinations are described in the following U. S. Pat. Nos. 1,144.210; 1,361,021; 1,439,404; 1,868,778; 2,242,536; 2,674,685; 3,510,643; 4,669,186; 5,857,268; 6,135,608; 6,336,731; 6,511,199; Des. 412,096 and Des. 412,355.

Such combination apparatus in the past, however, have not been adaptable as tactical devices for hand-to-hand combat against an opponent.

SUMMARY OF THE INVENTION

The present invention provides handheld tactical devices combining a weapon with a temporarily disabling emission generator in such manner that the emission generator may be used together with the weapon to gain a tactical advantage against an opponent engaged in hand-to-hand combat. Specifically, the user may actuate the emission generator to temporarily disable the opponent while in the process of applying the weapon against the opponent. Depending upon the combat situation, the user of the combination apparatus is permitted the option to actuate the emission generator of the combination for temporarily disabling the opponent for facilitating the opponent's capture without the user's employing the weapon against the disabled the opponent.

According to one aspect of the present invention, there is provided a tactical handheld apparatus comprising: an emission generator; a tubular handle having a longitudinal axis and configured for accommodating the emission generator therein, the handle including a first or front end portion having a first or front opening, the handle including a second or rear end portion having a second or rear opening for receiving the emission generator, the handle including a securement device at the handle's first portion outwardly of the first opening; a weapon component adapted to be secured to the securement device forwardly of the first opening and along the longitudinal axis; and a retainer securable to the second end portion of the handle (preferably removably securable thereto) for retaining the emission generator in the handle, the retainer having an opening aligned with the second opening when secured to the second end portion. The emission generator includes an actuator actuable by a user holding the handle for projecting an emission from the handle when the emission generator is accommodated in the handle.

The emission generator is adapted to be accommodated in the handle with the actuator actuable by the user at the second or rear opening, e.g. at the opening in the retainer; in such case, the emission generator will project an emission from the first or front opening. The emission generator is further adapted to be accommodated in the handle with the actuator actuable by the user at the first or front opening; in such case the emission will be projected from the second or rear opening, e.g. from the opening in the retainer.

In a preferred embodiment, the emission generator comprises a flashlight preferably with a pushbutton switch actuator at the flashlight's tail end, and the weapon component comprises a knife blade. The flashlight is retained within the handle with the pushbutton accessible to the user at the retainer opening while the user is holding the handle, and the flashlight projects a high-intensity light beam from the handle's first or front opening when the pushbutton is depressed by the user. The knife blade is configured such that the handle's front opening is not significantly obstructed when the knife blade is secured to the securement device of the handle.

In a second preferred embodiment of the invention, the emission generator comprises a chemical spray device having a pushbutton actuator actuable by the user at the second or rear opening, e.g. at the opening in the retainer. In such case, the chemical spray is projected through the handle's first or front opening, preferably from two spray nozzles laterally spaced from the handle's longitudinal axis for projecting sprays along opposite sides of the attached knife blade. The knife blade is configured such that the handle's first opening is not significantly obstructed when the knife blade is secured to the handle's securement device.

In a further preferred embodiment according to the present invention, the weapon component comprises a baton body adapted to be secured to the handle's securement device forwardly of the handle's first or front opening and along the handle's longitudinal axis. The emission generator preferably comprises a flashlight having a pushbutton switch actuator at its tail end, the flashlight being retained in the tubular handle with the pushbutton actuator actuable by the user at the handle's first or front opening. In this case, the flashlight's high-intensity light beam will be projected from the second opening, e.g. from the opening in the retainer. The baton body is configured such that the flashlight's pushbutton is accessible to the user when holding the handle, for permitting the user to depress and release the pushbutton for operating the flashlight.

In yet another preferred embodiment wherein the weapon component comprises the baton body secured to the handle's securement device forwardly of the handle's first front opening and along the handle's longitudinal axis, the emission generator comprises the chemical spray device. The chemical spray device may be inserted in the handle such that the spray device's pushbutton actuator is actuable by the user at the second or rear opening, e.g. at the opening in the retainer. The spray device preferably includes two spray nozzles laterally spaced from the handle's longitudinal axis for projecting sprays along opposite sides of the attached baton body. The baton body is preferably configured such that the handle's first or front opening is not significantly obstructed when the baton body is secured to the handle's securement device.

According to another aspect of the present invention, there is provided a preferred spray device embodiment comprising: a generally cylindrical housing having a longitudinal axis and a front wall including at least one (and preferably two) apertures through the front wall; at least one (and preferably two) generally cylindrical spray canisters longitudinally carried in the housing; at least one (and preferably two) nozzles coupling the canisters and the apertures respectively; a plug at the rear of the housing including a pushbutton for actuating the canisters to emit sprays from the nozzles; and a protective cover for the pushbutton hinged to the plug and biased for normally covering the pushbutton, the protective cover being pivotable away from the pushbutton when urged by a finger of a hand of a user utilized to hold the cover (or the tubular handle when used), and preferably when urged by the same finger utilized to depress the pushbutton.

In the preferred dual-canister spray device embodiment, the housing includes two side-by-side longitudinal bores terminating at the front wall and respectively communicating with the two apertures through the housing's front wall; and the two canisters are contained in the bores respectively and are removable from the housing through the housing's rear opening when the plug is removed from the rear of the housing.

BRIEF DESCRIPTION OF THE DRAWINGS

The novel features believed to be characteristic of the present invention, together with further advantages thereof, will be better understood from the following description considered in connection with the accompanying drawings in which preferred embodiments of the present invention are illustrated by way of example. It is to be expressly understood, however, that the drawings are for the purpose of illustration and description only and are not intended as a definition of the limits of the invention.

FIG. 17 is an exploded front/side view of a further preferred embodiment, specifically a baton or truncheon comprising the baton body secured to the handle as in FIG. 16, in combination with the spray device shown in FIG. 8;

FIG. 18 is a side elevation view of the assembled baton/spray device embodiment of FIG. 17;

FIG. 19 is a front view of the assembled baton/spray device embodiment of FIG. 18;

DETAILED DESCRIPTION OF THE PREFERRED EMBODIMENTS

Figure 1:
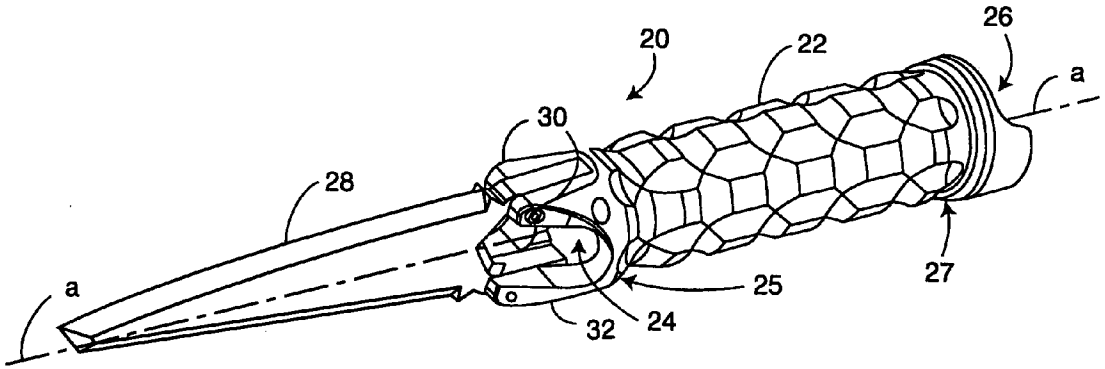
FIG. 1 is a front/side perspective view of a preferred embodiment according to one aspect of the present invention, specifically a knife comprising a knife blade secured to a tubular handle.

The various preferred combined weapon/emission generator embodiments of the present invention, as shown in the drawings, each include a tubular handle adapted for removably accommodating an emission generator therein, and for detachably attaching a weapon component thereto. The combination of the handle with the attached weapon component comprises a handheld tactical device or weapon, and the addition of the emission generator to the handle permits the resulting combination to be operated by a user to accomplish the tactical functions of both the weapon and the emission generator either separately or in concert.

For example, turning to FIGS. 1-6, a preferred knife embodiment 20 includes a generally tubular handle 22 extending along a longitudinal axis a and including a first or front opening or window 24 at the handle's first or front end portion 25 and a second or rear opening 26 at the handle's second or rear end portion 27.

As used herein, except where otherwise evident from the context, the word "longitudinal" means a direction along or parallel to the longitudinal axis a of the handle 22 or a direction along or parallel to the longitudinal axis a of the spray device 84; "front" or "forward" describes a longitudinal direction toward the distal end of a weapon component attached to the handle 22 (e.g., to the left as shown in FIGS. 1, 2, 4-8 and 11-14); "rear" or "rearward" describes the direction opposite the front (e.g., to the right as shown in the drawing of FIGS. 1, 2, 4-8 and 11-14); "above" or "upper" means vertically above when the handle 22 is held horizontally; and "below" or "lower" means vertically below when the handle 22 is held horizontally with the longitudinal arms of the attached weapon component positioned one above the other (see, e.g., FIGS. 4 and 16).

The handle's front end portion 25 is configured for securely holding a knife blade 28 such that the handle's front opening 24 is not significantly obstructed. In one such preferred configuration, the handle front end portion 25 includes, outwardly of the front opening 24, two first or upper longitudinal forwardly-directed projections 30 transversely separated by a first or upper longitudinal slot 34, and two second or lower longitudinal forwardly-directed projections 32 transversely separated by a second or lower longitudinal slot 36. The proximal or rear end portion 38 of the knife blade 28 forms a generally U-shaped projection including a first or upper longitudinal rearwardly-directed arm 40 and a second or lower longitudinal rearwardly-directed arm 42. The arms 40 and 42 are configured for being fittingly received in the longitudinal slots 34 and 36, respectively, and for being removably secured to the respective upper and lower pairs of forward projections 30 and 32, such as by transversely disposed headed screws 44 inserted in transverse bores 46 in the projections 30, 32 and transverse bores 48 in the arms 40, 42, and threadedly cooperating with transverse threaded bores 50 in the opposing longitudinal forward projections 30, 32.

The base 51 of the generally U-shaped rear end of the knife blade 28 (i.e. the edge 51 adjoining the two arms 40, 42 and facing the handle's front opening 24) is preferably beveled so as to diminish any rearward reflection of light emanating from the opening 24 when a flashlight 52 is contained within the generally cylindrical cavity of the tubular handle 22 and actuated.

As specifically shown in FIGS. 2-5, an example of an emission generator for being carried by the handle 22 comprises the flashlight 52, preferably a tactical flashlight capable of generating a high intensity light beam that could temporarily blind and/or disorient an adversarial combatant. The flashlight 52 includes a generally cylindrical battery housing 54 containing a battery (comprising one or more battery cells 56), a flashlight head 58 including a light emitter or lamp 60 (such as an incandescent bulb or a high luminous flux light emitting diode), and a reflecting device 62 (such as a parabolic reflector or a total internally reflecting lens) for substantially longitudinally directing the light from the lamp 60 through a transparent plate or lens 64. The preferred example of the flashlight 52 includes a tail cap 66 removably secured to the battery housing 54, the tail cap 66 housing a switch 68 actuable by a pushbutton 70. The lamp 60, battery 56 and pushbutton switch 66 are in circuit such that the ON/OFF conditions of the lamp 60 are controlled by a user's selective longitudinal depression and/or release of the pushbutton 70. Pushbutton actuated flashlights are well known in the flashlight art as described, for example, in U.S. Pat. Nos. 6,841,941, 5,642,932, 4,733,337, and U.S. Patent Application Publication US-2005-0077837-A1, each of which patents and publication are incorporated herein by reference.

Figure 3:
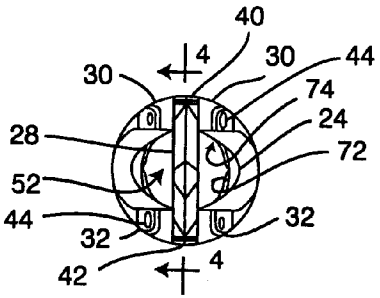
FIG. 3 is a front view of the knife blade and handle combination of FIG. 1 assembled with the flashlight shown in FIG. 2.
Figure 4:
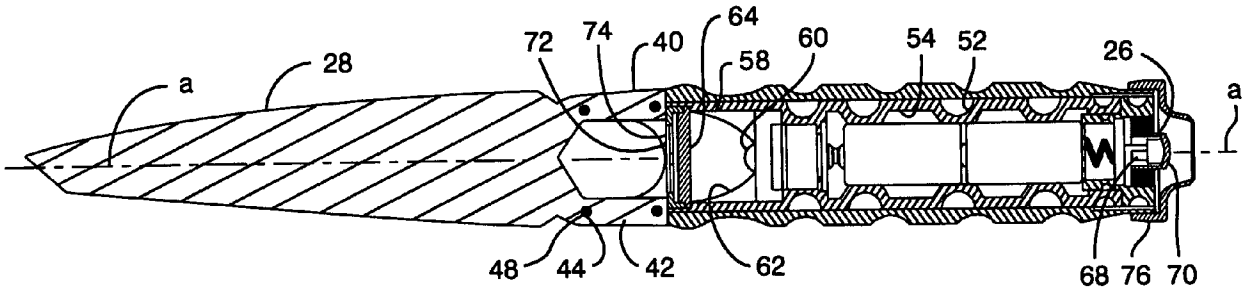
FIG. 4 is a cross-sectional view of the assembled knife/flashlight combination of FIGS. 2 and 3, taken along the line 4-4 of FIG. 3 and viewed in the direction of the appended arrows.
Figure 5:
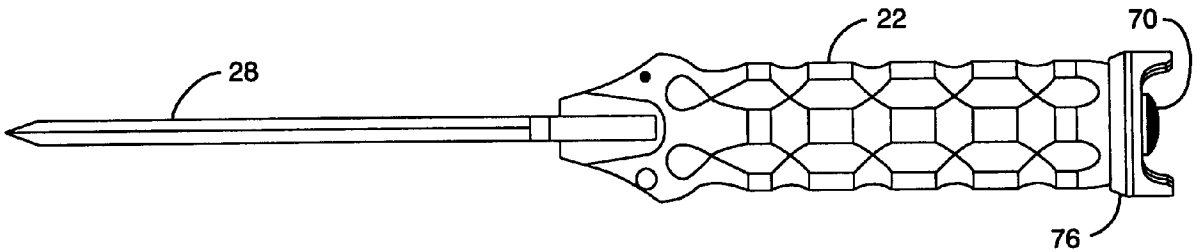
FIG. 5 is a top plan view of the assembled knife/flashlight combination.
Figure 6:
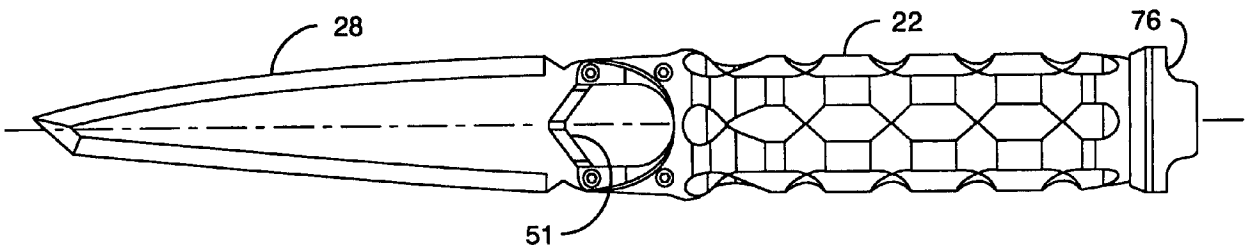
FIG. 6 is a side elevation view of the assembled knife/flashlight combination.
Figure 7:
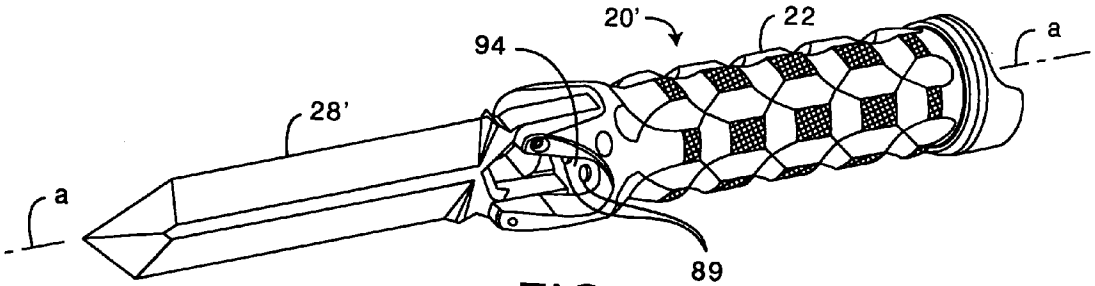
FIG. 7 is a front/side perspective view of another preferred embodiment of a knife blade/handle combination, in further combination with a disabling spray device carried by the handle according to the present invention.

For equipping the knife 20 with the flashlight 52, the flashlight 52 is inserted (front end first in the embodiment shown) through the rear opening 26 of the hollow handle 22, until segments of the forward edge 72 of the flashlight head 58 engage the rear surface of the inwardly directed edge 74 of the front end portion 25 of the handle 22 (see FIGS. 3 and 4).

Figure 2:
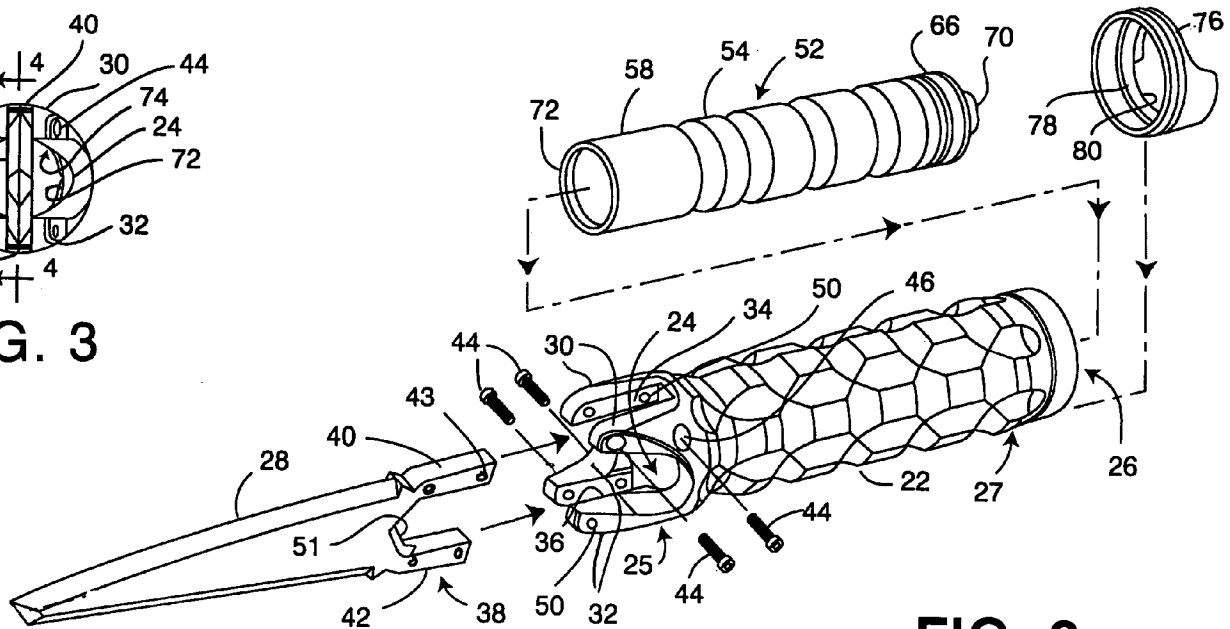
FIG. 2 is an exploded view of the knife of FIG. 1, in combination with a flashlight carried by the handle in accordance with the present invention.

A retainer ring 76 is thereupon secured to the handle end portion 27, such as by cooperative screw threads on the exterior longitudinal surface of the rear end portion 27 and the interior longitudinal surface of the ring 76. The ring 76 includes an annular inwardly-directed radial wall or lip 78 for longitudinally engaging the peripheral rear edge of the tail cap 66, the installed retainer ring 76 retaining the flashlight 52 within the tubular handle 22 while permitting the tail cap pushbutton 72 to be exposed by and preferably rearwardly protrude from the ring's central opening or aperture 80 defined by the interior edge of the radial lip 78 (FIG. 2). The length and diameter of the preferred flashlight 52 are such that the flashlight fits within the tubular cavity of the handle 22 (with at least portions of the outer surface of the flashlight 52 contacting the inner surface of the handle 22), is retained against longitudinal movement by the handle's front end portion inwardly-directed edge 74 and the installed retainer ring 76, and is slidably insertable into and removable from the handle's tubular cavity when the retainer ring 76 is unthreaded and removed from the handle 22.

The knife embodiment 20' shown in FIGS. 7-14 includes the tubular handle 22 and the retainer ring 76 shown in FIG. 1, and a knife blade 28' which is of different cutting edge configuration than, but which may have a cutting edge configuration similar to, the knife blade 28 of FIG. 1. It may be appreciated that the knife blade 28 of FIG. 1 may be replaced by the knife blade 28' of FIG. 7, or by any other configuration of knife blade, provided that—for the preferred embodiments shown—the knife blade's rear end is configured similarly to the knife blade rear end 38 as in FIG. 2. Accordingly, the knife blade 28' of the knife embodiment 20' of FIGS. 7-14 includes a rear end portion 38' similar to the rear end portion 38 of FIGS. 1-6, including the upper and lower rearward arms 40, 42 fittingly securable within the handle front end longitudinal slots 34, 36 of the upper and lower pairs of forward projections 30, 32, respectively, by the screws 44, in the same manner as described above in connection with the securement of the knife blade 28 to the handle 22 shown in FIGS. 1-6. It may be further appreciated that the knife blade 28 of FIG. 1 may be substituted for the knife blade 28' in the knife 20' of FIG. 7.

As specifically shown in FIGS. 7-12, an example of another emission generator for being carried by the tubular handle 22 comprises a pushbutton-actuable spray generating device for emitting a disabling irritant when sprayed in an opponent's eyes or nose. Disabling spray devices are well known in the art, such as including a cylindrical housing containing a pressurized cannister of capsaicin pepper spray chemical with a pushbutton actuator at the housing's rear end and a spray nozzle at the housing's forward end.

Figure 8:
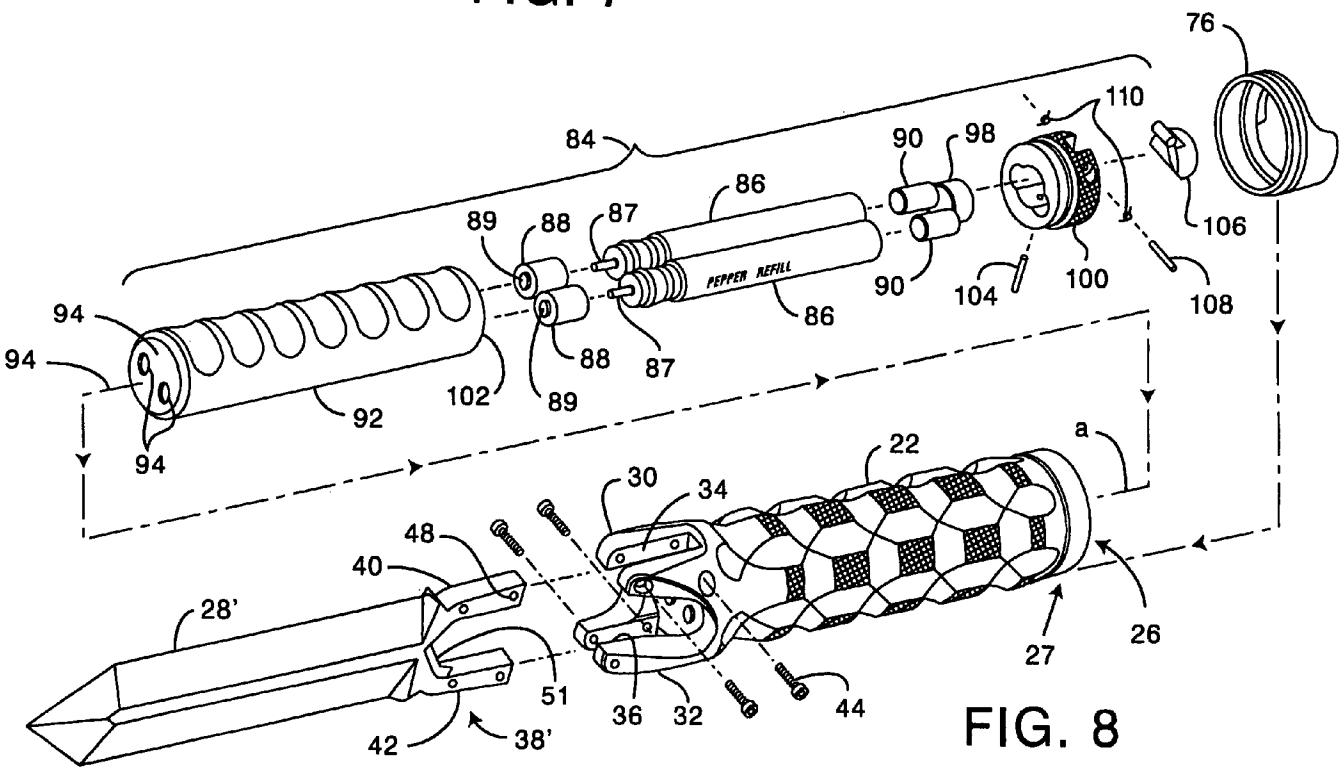
FIG. 8 is an exploded front/side perspective view of the knife/spray device combination shown in FIG. 7.
Figure 11:
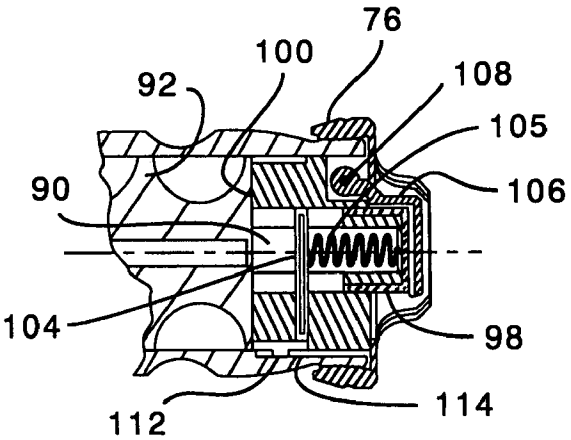
FIG. 11 is a cross-sectional view (in enlarged scale) of a rear end fragment of the assembled knife/spray device combination, taken along the line 11-11 of FIG. 10 and viewed in the direction of the appended arrows.
Figure 10:
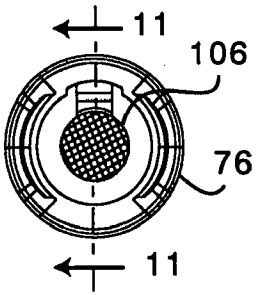
FIG. 10 is a rear view of the assembled knife/spray device combination of FIG. 7.

One manner of combining a disabling spray device 84 with the handle 22 of the present invention is illustrated in FIG. 8, the disabling spray device 84 including at least one and preferably two pressurized capsaicin pepper spray chemical cylindrical cannisters 86 each having an outlet tube 87 at its forward end communicating with and retained against forward movement by respective spray nozzles 88. Each outlet tube 87 operates a valve within its cylinder 86, opening the valve when the cylinder is axially urged toward the nozzle 88 and closing the valve upon release of such axial urging, for example as disclosed in U.S. Pat. Nos. 5,509,581 and 5,839,624 to Kevin L. Parsons, which patents are incorporated herein by reference.

As shown in FIGS. 8, 12, 20 and 21, the preferred embodiment of the chemical spray device 84 of the present invention includes a generally cylindrical housing 92 having a longitudinal axis a. Two chemical spray cylinders 86 are situated within side-by-side longitudinal bores 93 in housing 92, along with their respective nozzles 88.

Referring to FIGS. 8-12, the chemical spray device 84 includes pushbutton actuators 90 at the rear ends of the respective cylinders 86. The housing 92 has a front end wall 94 including apertures 96 respectively aligned with and retaining forward protuberances or nipples 89 of the nozzles 88 for permitting the chemical spray to be emitted therefrom when the pushbuttons 90 are forwardly urged, the cylinders 86 being longitudinally slidable along their respective bores 93.

The two pushbuttons 90 are controlled by a third pushbutton 98, and the three pushbuttons are preferably fabricated as a unitary component retainably housed in a generally cylindrical end plug 100 removably secured to the housing 92 and plugging the housing's rear end opening 102. The interior longitudinal passage in the end plug 100 is configured for longitudinally holding the controlling central pushbutton 98 and the pushbuttons 90, with the two pushbuttons 90 being in side-by-side arrangement with a vertical (orthogonal to the longitudinal axis a) roll pin 104 retained by the end plug 100 and disposed between the two pushbuttons 90. A spring 105 is retained between the roll pin 104 and the central pushbutton 98 for rearwardly biasing the pushbutton assembly within the end plug 100. The forward end wall 94 is configured for holding the nozzle protuberances 89 and retaining the nozzles 88 in side-by-side arrangement longitudinally aligned with the respective cylinders 86 and pushbuttons 90. A spring biased hinged end cover 106 is preferably installed in the end plug 100, pivotable about transverse pin 108 and engaged with torsion springs 110. The spring biased hinged cover 106 normally covers the central control pushbutton 98 for preventing inadvertent depression of the pushbutton 98. A user may urge the cover 106 to pivot away from the pushbutton 98 with a finger of the same hand used for holding the handle 22 and indeed with the same finger used by the user to depress the pushbutton 98.

Figure 9:
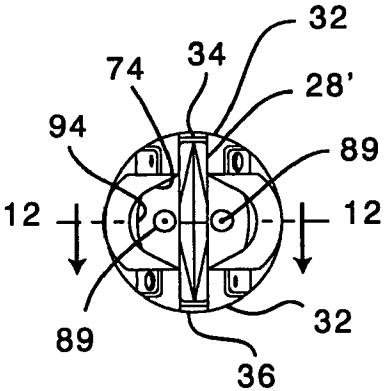
FIG. 9 is a front view of the assembled knife/spray device combination of FIG. 7.
Figure 12:
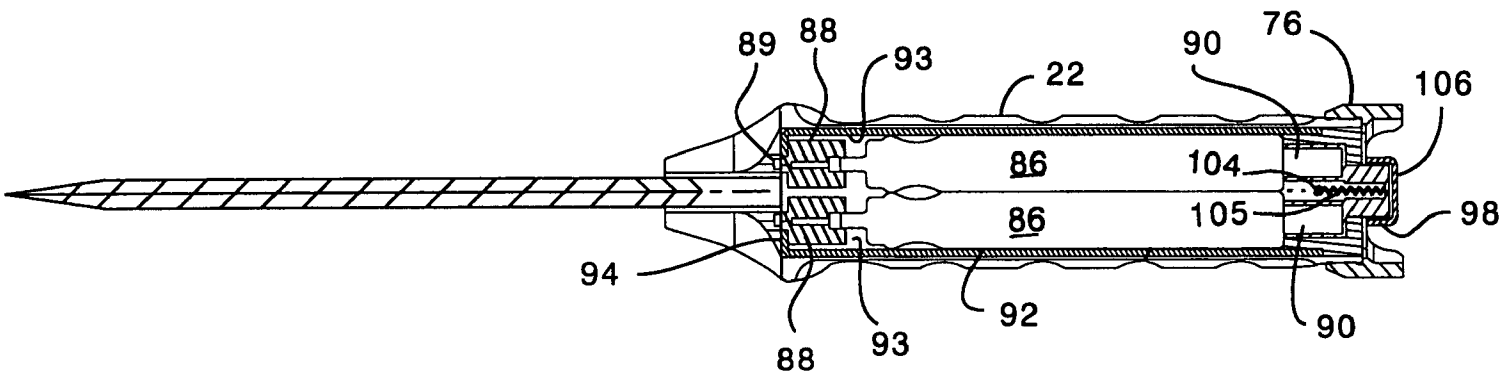
FIG. 12 is a cross-sectional view of the assembled knife/spray device combination, taken along the line 12-12 of FIG. 9 and viewed in the direction of the appended arrows.
Figure 13:
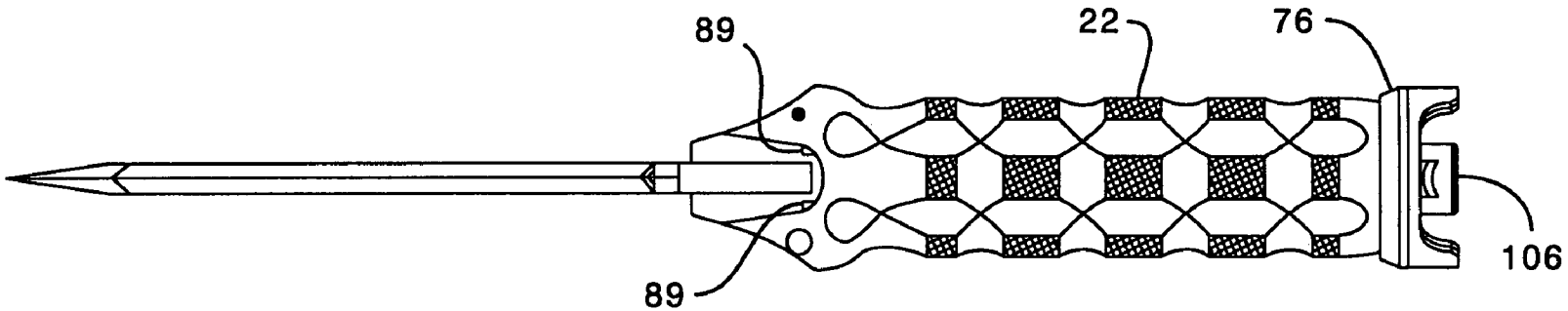
FIG. 13 is a top plan view of the assembled knife/spray device combination.
Figure 14:
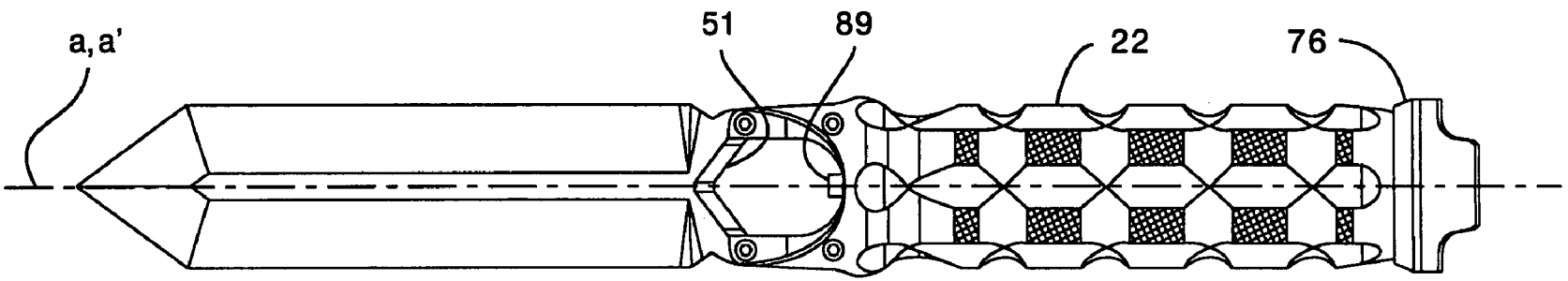
FIG. 14 is a side view of the assembled knife/spray device combination.

For equipping the knife 20' with a disabling spray capability, the assembled chemical spray device 84 is inserted (front end first in the embodiment shown) through the rear opening 26 of the hollow handle 22, until segments of the forward end 94 of the housing 92 engage the rear surface of the inwardly directed edge 74 of the front end portion 25 of the handle 22 (see FIGS. 8 and 9). At the same time, the housing 92 is rotationally adjusted with respect to the handle 22 for circumferentially indexing the spray device 84 to the handle 22 such that the nozzle nipples 89 are laterally disposed with respect to the secured knife blade 28' and for preventing rotation of the spray device 84 with respect to the handle 22, for example by means of a radial protuberance or pin 112 on the outer surface of the housing 92 being received by a longitudinal channel 114 in the inner surface of the rear end portion 27 of the handle 22 (see FIGS. 11 and 21). The assembly 84 is longitudinally retained in the handle 22 upon installing the retaining ring 76 onto the rear end portion 27 of the handle 22 in the manner previously described in connection with the flashlight 52, and with the pushbutton 98 and its cover 106 rearwardly protruding from the end plug 100 and from the central aperture 80 of the retaining ring 76.

The length and diameter of the assembled preferred disabling spray device 84 are such that the device 84 fits within the generally cylindrical cavity of the handle 22 (with at least portions of the outer surface of the housing 92 contacting the inner surface of the hollow handle 22), is retained against longitudinal movement by the handle's front end portion inwardly directed edge 74 and the installed retainer ring 76, and is slidably insertable into and removable from the tubular handle 22 when the retainer ring 76 is removed from the handle 22.

When the disabling spray assembly 84 is installed in the handle 22, the two outlets 89 of the nozzles 88 are disposed on transversely opposing sides of the installed knife blade 28'. The U-shaped edge 51 at the rear end portion 38' of the knife blade 28' is preferably beveled so as to diminish any rearward deflection of chemical spray emanating from the nozzles 88 when the pushbutton 98 is depressed.

In the knife embodiment 20 of FIGS. 2-6, the flashlight 52 may be removed from the handle 22 (by removing the retaining ring 76 and rearwardly sliding the flashlight 52 through the rear end opening 26) and replaced with the chemical spray assembly 84 or any other suitably configured emission generator. Similarly, in the knife embodiment 20' of FIGS. 7-14, the chemical spray assembly 84 may be removed from the handle 22 (by removing the retaining ring 76 and rearwardly sliding the assembly 84 through the rear end opening 26) and replaced with the flashlight 52 or any other suitably configured emission generator.

The knife embodiments of the present invention are useful as handheld tactical devices in hand-to-hand combat. Where a flashlight is carried by the handle as in FIGS. 2-6, the knife blade and its cutting tip extend forwardly from the light emitting end of the handle, with the light beam propagating along the knife blade when the flashlight is actuated. A user may direct the emitting light beam toward his/her opponent to produce a blinding and temporary disorienting and disabling result on the opponent, and the user may simultaneously strike the opponent with the knife blade. This operation can effectively be conducted by the user's grasping the handle 22 with his/her hand, and then depressing the tail cap switch pushbutton 70 with his/her thumb to suddenly cause a bright beam of light to be emitted toward the opponent's eyes, while the user rapidly moves the knife/flashlight combination for striking the opponent.

Similarly, in the knife/chemical spray device embodiment of FIGS. 7-14, the knife blade and its cutting tip extend forwardly from the spray emitting end of the handle 22, the spray propagating along the knife blade when actuated. The user may direct the emitting spray towards the opponent to effect a disabling result on the opponent. The user may simultaneously strike the opponent with the knife, or the user may decide that the disabling result is sufficient for enabling him/her to disarm the opponent and take him/her into custody. This operation can most effectively be conducted by the user's grasping the handle 22 in his/her hand using his/her thumb to pivot the hinged cover 106 to expose the pushbutton 98 to his/her thumb, and then depressing the pushbutton 98 to suddenly cause the chemical spray to be emitted as the knife/chemical spray device is directed toward the opponent's eyes and nose.

It may be appreciated that the knife/handle combination of FIG. 1 may be used simply as a knife, without either a flashlight or a chemical spray device contained within the handle. Similarly, the flashlight 52, as well as the chemical spray device 84, may be removed from the handle 22 and operated individually and independently of the knife/handle combination.

Figure 15:
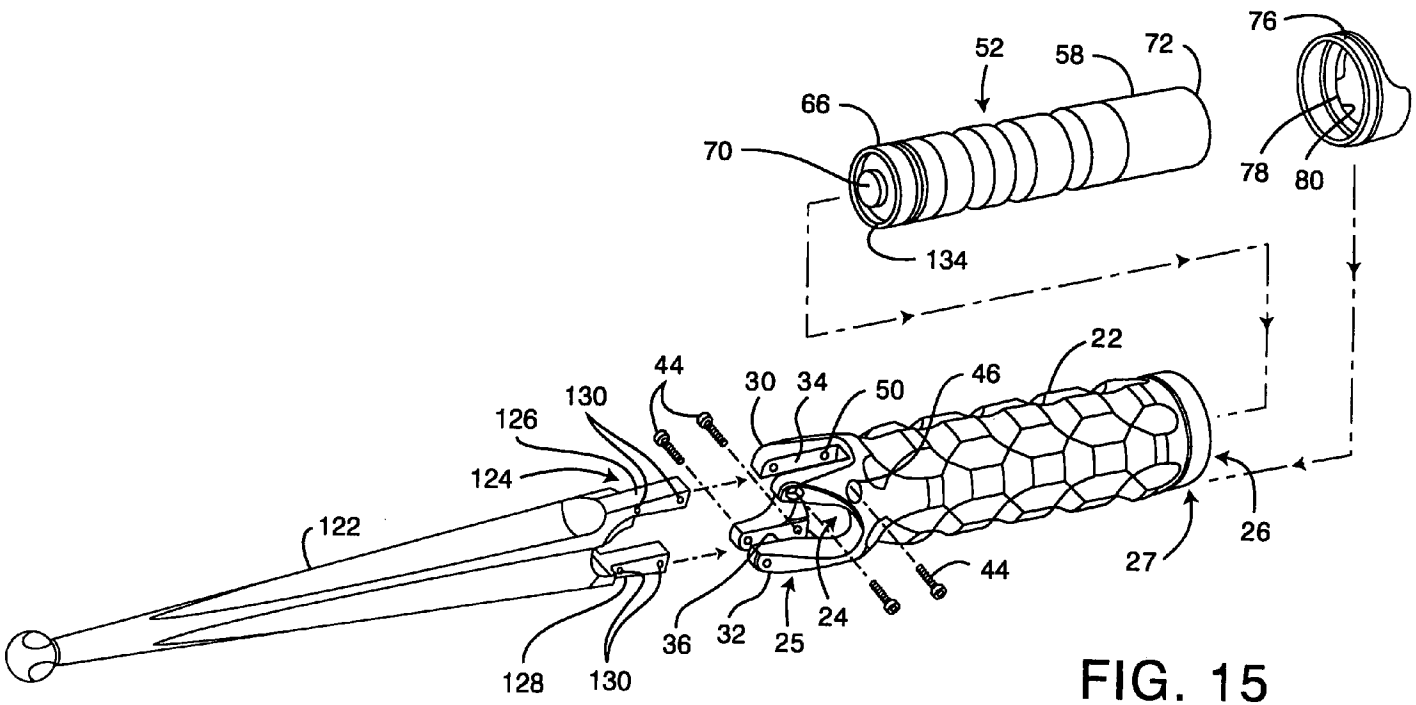
FIG. 15 is an exploded front/side view of another preferred embodiment according to the present invention, specifically a baton or truncheon comprising a baton body secured to the handle as in FIGS. 2 and 8, in combination with a flashlight carried by the handle.
Figure 16:
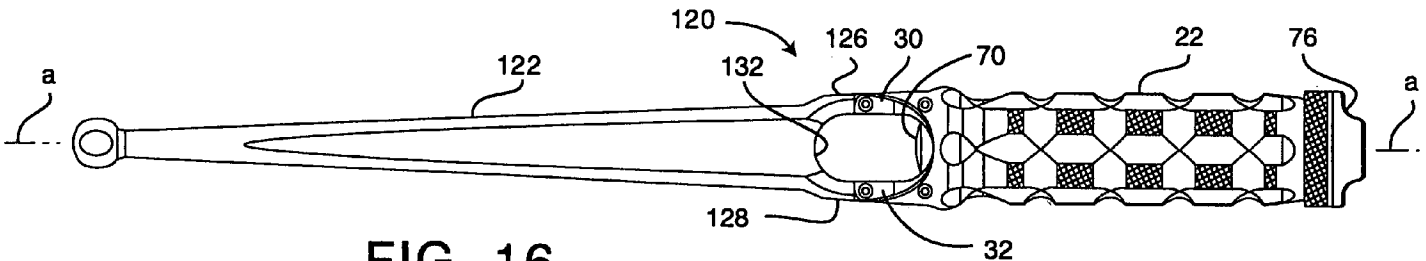
FIG. 16 is a side elevation view of the assembled baton/flashlight embodiment of FIG. 15.

Another preferred embodiment of the present invention, specifically a baton or truncheon combined with an emission generator such as a flashlight, is shown in FIGS. 15 and 16. A preferred baton embodiment 120 includes a generally tubular handle—preferably the previously described handle 22—extending along the longitudinal axis a and including the front opening or window 24 at the handle's front end portion 25 and a rear opening 26 at the handle's rear end portion 27.

The handle's front end portion 25 is configured for securely holding a baton body 122 in such manner that the front opening 24 is not significantly obstructed. In similar manner as previously described with respect to the knife blade 28 being held by the handle 22, the preferred handle front end portion 25 includes, outwardly of the front opening 24, two first or upper longitudinal forwardly-directed projections 30 transversely separated by a first or upper longitudinal slot 34, and two second or lower longitudinal forwardly-directed projections 32 transversely separated by a second or lower longitudinal slot 36. The proximal or rear end portion 124 of the baton body 122 forms a generally U-shaped projection including a first or upper longitudinal rearwardly-directed arm 126 and a second or lower longitudinal rearwardly-directed arm 128. The arms 126 and 128 are configured for being fittingly received in the longitudinal slots 34 and 36, respectively, and for being removably secured to the respective upper and lower pairs of forward projections 30 and 32 of the handle 22, such as by transversely disposed headed screws 44 inserted in transverse bores 46 in the projections 30, 32, transverse bores 130 in the arms 126, 128, and threadedly cooperating with transverse threaded bores 50 in the opposing longitudinal forward projections 30, 32.

As specifically shown in FIGS. 15 and 16, an example of an emission generator for being carried by the handle 22 in the preferred baton embodiment 120 comprises a flashlight such as the flashlight 52 previously described. However, whereas the flashlight 52 is inserted in the handle 22 of the knife embodiment shown such that the flashlight's light beam emanates from the front opening 24, in the baton embodiment 120 the flashlight 52 is preferably disposed in the handle 22 such that the flashlight's light beam emanates from the handle's rear opening 26 while the flashlight's tail cap switch pushbutton 70 rearwardly projects from or is otherwise accessible at the handle's front opening 24. The base of the generally U-shaped rear end of the baton body 122 (i.e. the edge 132 adjoining the two arms 126, 128 and facing the handle's front opening 24) is preferably shaped and sufficiently spaced from the handle's front opening 24 so as to permit a user to comfortably insert a finger rearwardly of the edge 132 for depressing and releasing the pushbutton 70.

For equipping the baton 120 with the flashlight 52, the flashlight 52 is inserted (tail end facing forwardly) through the rear opening 26 of the handle 22, until segments of the rear edge 134 of the tail cap 66 engage the rear surface of the inwardly directed edge 74 of the front end portion 25 of the handle 22.

The retaining ring 76 is thereupon secured to the handle rear end portion 27, such as by cooperative screw threads on the exterior longitudinal surface of the handle's rear end portion 27 and the interior longitudinal surface of the ring 76, as previously discussed. The annular inwardly directed radial wall or lip 78 of the ring 76 longitudinally engages the peripheral front edge 72 of the flashlight head 58, the installed retaining ring 76 retaining the flashlight 52 within the tubular handle 22 while permitting the flashlight's light beam to emanate rearwardly from the ring's central opening or aperture 80 defined by the internal edge of the radial lip 78. As previously indicated, the length and diameter of the flashlight 52 are such that the flashlight 52 fits within the cavity of the tubular handle 22, is retained against longitudinal movement by the handle's front end portion inwardly directed edge 74 and the installed end ring 76, and is slidably insertable into and removable from the handle's tubular cavity when the retainer ring 76 is removed from the handle 22.

It may be appreciated that a user may grasp the handle in a generally forward attitude for using the baton as a truncheon against an opponent. Immediately before such use, however, the user may reverse the direction of the baton and may depress the pushbutton 70 with his/her thumb or other finger to actuate the flashlight for producing a momentary blinding or disorienting effect on the opponent. Alternatively, a user may grasp the handle in a generally rearward attitude for using the baton/flashlight combination as a flashlight, the user having the option to use the baton/flashlight combination as a baton or truncheon should the need arise.

Of course, the flashlight may be used simply as a flashlight whether the flashlight 52 is installed in the handle 22 or removed therefrom. When the flashlight 52 is installed in the baton's handle 22, the user may hold the baton body 122 rearwardly between one of his arms and his torso while directing the light beam in a generally forward direction, for being able to have his/her hands free for another related purpose, for example for permitting a law enforcement officer user to illuminate a clipboard or traffic ticket booklet held with one hand while writing a traffic ticket with the other hand and, at the same time, having the baton at the ready if needed.

The emission generator in the baton device may comprise a disabling spray device such as the chemical spray device 84. In a preferred embodiment, the spray device 84 is inserted and retained in the tubular handle such that the chemical spray emanates forwardly from the front opening 24 of the handle 22 while the spray device's actuating pushbutton 98, protectively covered by the spring biased hinged cover 106, is accessible at the rear opening 26 of the handle 22 (i.e., at the central opening 80 of the retainer ring 76), as shown in FIGS. 17-19. The assembled chemical spray device is inserted (front end first in the embodiment shown) through the rear opening 26 of the hollow handle 22, until segments of the forward end wall 94 of the housing 92 engage the rear surface of the inwardly directed edge 74 of the front end portion 25 of the handle 22. At the same time, the housing 92 is rotationally adjusted with respect to the handle 22 for circumferentially indexing the spray device 24 to the handle 22 such that the nozzle nipples 89 are laterally disposed with respect to the secured baton body 122 and for preventing rotation of the spray device 84 with respect to the handle 22, such as by means of the radial protuberance or pin 112 on the outer surface of the housing 92 being received by the longitudinal channel 114 in the inner surface of the rear end portion 27 of the handle 22 (see FIGS. 11 and 21). The outer surface of the baton body 122 is preferably configured with two longitudinal channels 136, one on each side of the baton body 122 in registration with the two nozzle nipples 89 respectively, for permitting the spray to propagate along the baton body when the spray device 84 is actuated. The spray device 84 is longitudinally retained in the handle 22 upon installing the retaining ring 86 onto the rear end portion 27 of the handle 22 in the manner previously described, with the pushbutton 98 and its cover 106 rearwardly protruding from the end plug 100 at the central aperture 80 of the retaining ring 76.

When using this embodiment of the baton/spray device combination, the user may grasp the handle 22 in a generally forward attitude for using the baton as a truncheon against an opponent, the user using his/her thumb to pivot the hinged cover 106 to expose the pushbutton 98 to his/her thumb. The user may depress the pushbutton 98 (which exposure and depression may be accomplished in one motion of the thumb) to actuate the chemical spray for producing a temporarily disabling effect on the opponent, permitting the user the option of either striking the opponent with the baton or, if the situation permits, disarming the opponent and taking the opponent into custody without need to strike the opponent.

Figure 20:
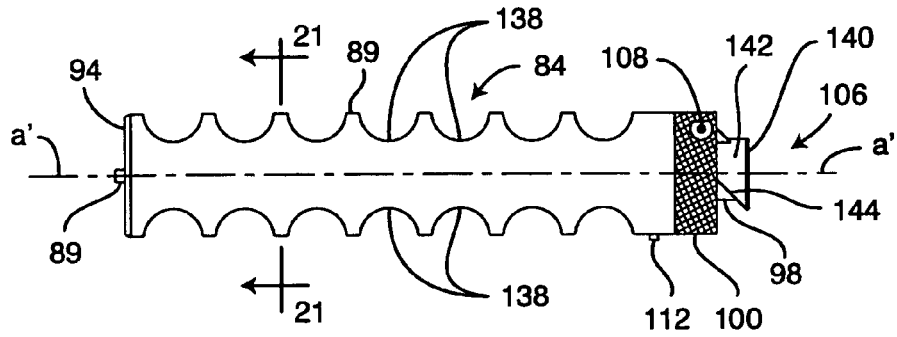
FIG. 20 is a side elevation view of the assembled spray device shown in FIGS. 8-14 and 17-19.
Figure 21:
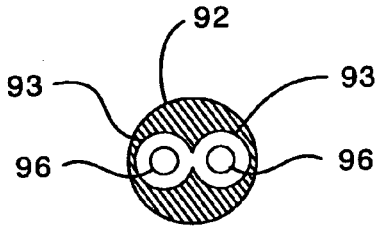
FIG. 21 is a cross-sectional view of the spray device housing, taken along the line 21-21 of FIG. 20 and viewed in the direction of the appended arrows.
Figure 22:
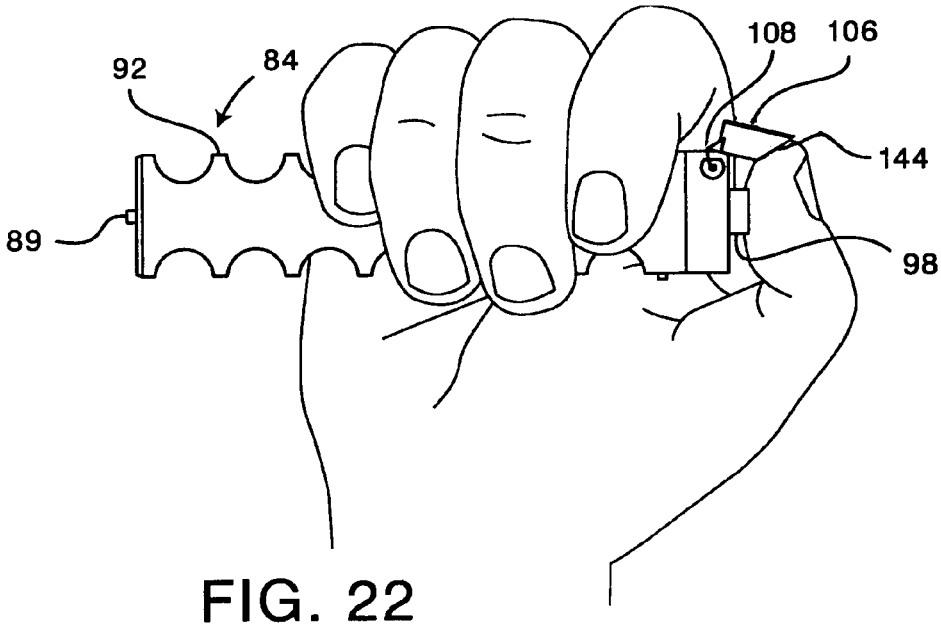
FIG. 22 is an illustration of a user operating the spray device shown in FIG. 20 as a separate unit.

The spray device 84 may be used by itself, and the preferred embodiment thereof includes a plurality of longitudinally spaced transverse depressions 138 in the outer surface of the housing 92 for facilitating gripping by the user's hand, the depressions 138 preferably extending along the housing's upper and lower surfaces for accommodating both right-handed and left-handed users (see FIGS. 17, 20 and 22). As illustrated in FIG. 22, in a preferred manner of using the spray device 84 by itself, the user grasps the spray device 84 in his/her hand, in a generally forward attitude, using his/her thumb to urge the hinged cover 106 away from the pushbutton for exposing the pushbutton 98 to his/her thumb, and then depressing the pushbutton 98 to cause the chemical spray to be emitted from each of the nipples 89 of both nozzles 88 toward the opponent's eyes and nose. It may be appreciated that the hinged cover 106 may be urged away from the pushbutton 98 by a finger of the user's hand utilized by him/her to hold the housing 92, and indeed by the same finger utilized by the user to depress the pushbutton. Accordingly, exposure of the pushbutton 98 and its depression may be accomplished in one motion of the user's finger (preferably his/her thumb) of the hand utilized to hold the spray device 84.

For example, the cover 106 may be configured as a cap enclosing the pushbutton 98, with the cap's rear wall 140 rearwardly spaced from the pushbutton's rear face when front edge of the cap's generally cylindrical side 142 contacts the rear surface of the end plug 100. A portion 144 of the cap's side 142 opposite its hinge is cutaway or contoured to accommodate the tip of a user's thumb when the user holds the device 84 in his/her hand (see FIG. 22).

The various components of the disclosed embodiments may be manufactured using fabrication methods well known in the art, of well known materials typically used in the weaponry art including high strength and durable materials such as titanium, aluminum and steel alloys, as well as polymeric materials, although the knife blades are preferably fabricated of steel.

Thus, there have been described various preferred embodiments of handheld tactical devices combining a weapon with an emission generator, and specifically combinations of a tubular handle with a detachably securable knife blade or baton body, together with a flashlight or chemical spray device removably insertable in the tubular handle. The preferred spray device embodiment emits dual sprays and includes a thumb-operable cover for permitting a user to both expose and depress the spray device's pushbutton actuator for instantly actuating the spray device. Other embodiments of the present invention, and variations of the embodiments presented herein, may be developed without departing from the essential characteristics thereof. Accordingly, the invention should be limited only by the scope of the claims listed below.

I claim:

1. Handheld tactical apparatus comprising:

an emission generator;

a tubular handle having a longitudinal axis and configured for accommodating said emission generator therein, said handle including a first end portion having a first opening, said handle including a second end portion having a second opening for receiving said emission generator, said first end portion including two forwardly-directed upper projections outwardly of said first opening and transversely separated by an upper longitudinal slot, said first end portion including two forwardly-directed lower projections outwardly of said first opening transversely separated by a lower longitudinal slot;

a weapon component adapted to be secured to said handle forwardly of said first opening and along said longitudinal axis, said weapon component including a generally U-shaped proximal end having a rearwardly-directed upper arm and a rearwardly-directed lower arm configured for respectively being fittingly received by said longitudinal slots;

fasteners for securing said upper arm to said upper projections and said lower arm to said lower projections with said arms respectively received in said longitudinal slots; and a retainer adapted to be secured to said second end portion of said handle for retaining said emission generator in said handle, said retainer having an opening aligned with said second opening when secured to said second end portion.

2. The apparatus according to claim 1, wherein:

said weapon component is adapted to be removably secured to said handle.

3. The apparatus according to claim 1, wherein:

said retainer is adapted to be removably secured to said second end portion.

4. The apparatus according to claim 1, wherein:

said emission generator includes an actuator actuable by a user holding said handle for projecting an emission from said handle when said emission generator is accommodated in said handle.

5. The apparatus according to claim 4, wherein:

said weapon component comprises a knife blade.

6. The apparatus according to claim 4, wherein:

said weapon component comprises a baton body.

7. The apparatus according to claim 4, wherein:

said emission generator comprises a flashlight.

8. The apparatus according to claim 4, wherein:

said emission generator comprises a spray device.

9. The apparatus according to claim 8, wherein:

said spray device includes two nozzles for projecting sprays along opposite sides of said weapon component.

10. The apparatus according to claim 8, wherein:

said spray device includes a protective cover for said actuator pivotable away from said actuator by a finger of the user's hand utilized to hold said handle when said spray device is accommodated in said handle.

11. The apparatus according to claim 8, wherein:

said spray device includes a protective cover for said actuator pivotable away from said actuator by a finger of the user utilized to actuate said actuator.

12. The apparatus according to claim 4, wherein:

said emission generator is adapted to be accommodated in said handle with said actuator actuable by the user at said second opening for projecting the emission from said first opening.

13. The apparatus according to claim 12, wherein:

said emission generator comprises a flashlight.

14. The apparatus according to claim 13, wherein:

said weapon component comprises a knife blade.

15. The apparatus according to claim 12, wherein:

said emission generator comprises a spray device.

16. The apparatus according to claim 15, wherein:

said weapon component comprises a knife blade.

17. The apparatus according to claim 15, wherein:

said weapon component comprises a baton body.

18. The apparatus according to claim 4, wherein:

said emission generator is adapted to be accommodated in said handle with said actuator actuable by the user at said first opening for projecting an emission through said second opening.

19. The apparatus according to claim 18, wherein:

said weapon component comprises a baton body.

20. The apparatus according to claim 19, wherein:
said emission generator comprises a flashlight.

21. Handheld tactical apparatus comprising:
a tubular handle having a longitudinal axis, said handle including a first end portion having a first opening, a second end portion having a second opening, said first end portion including two forwardly-directed upper projections outwardly of said first opening and transversely separated by an upper longitudinal slot, said first end portion including two forwardly-directed lower projections outwardly of said first opening transversely separated by a lower longitudinal slot;
a weapon component secured to said handle forwardly of said first opening and along said longitudinal axis, said weapon component including a generally U-shaped proximal end having a rearwardly-directed upper arm and a rearwardly-directed lower arm respectively fittingly received by said longitudinal slots;
fasteners securing said upper arm to said upper projections and said lower arm to said lower projections; and
an emission generator carried in said tubular handle between said first end portion and said second end portion.

22. The apparatus according to claim 21, wherein:
said second end portion is configured for permitting removal of said emission generator from said handle through said second opening; and
said apparatus includes a retainer secured to said second end portion and retaining said emission generator in said handle, said retainer having an opening aligned with said second opening.

23. The apparatus according to claim 22, wherein:
said retainer is removably secured to second end portion.

24. The apparatus according to claim 21, wherein:
said weapon component is removably secured to said handle.

25. The apparatus according to claim 21, wherein:
said emission generator includes an actuator actuable by a user holding said handle for projecting an emission from said handle.

26. The apparatus according to claim 25, wherein:
said weapon component comprises a knife blade.

27. The apparatus according to claim 25, wherein:
said weapon component comprises a baton body.

28. The apparatus according to claim 25, wherein:
said emission generator comprises a flashlight.

29. The apparatus according to claim 25, wherein:
said emission generator comprises a spray device.

30. The apparatus according to claim 29, wherein:
said spray device includes two nozzles for projecting sprays along opposite sides of said weapon component.

31. The apparatus according to claim 29, wherein:
said spray device includes a protective cover for said actuator pivotable away from said actuator by a finger of the user's hand utilized to hold said handle.

32. The apparatus according to claim 29, wherein:
said spray device includes a protective cover for said actuator pivotable away from said actuator by a finger of the user utilized to actuate said actuator.

33. The apparatus according to claim 25, wherein:
said emission generator is carried in said handle with said actuator actuable by the user at said second opening for projecting the emission from said first opening.

34. The apparatus according to claim 33, wherein:
said emission generator comprises a flashlight.

35. The apparatus according to claim 34, wherein:
said weapon component comprises a knife blade.

36. The apparatus according to claim 33, wherein:
said emission generator comprises a spray device.

37. The apparatus according to claim 36, wherein:
said weapon component comprises a knife blade.

38. The apparatus according to claim 36, wherein:
said weapon component comprises a baton body.

39. The apparatus according to claim 25, wherein:
said emission generator is adapted to be accommodated in said handle with said actuator actuable by the user at said first opening for projecting an emission through said second opening.

40. The apparatus according to claim 39, wherein:
said weapon component comprises a baton body.

41. The apparatus according to claim 40, wherein:
said emission generator comprises a flashlight.

* * * * *